US005577890A

United States Patent [19]

Nielsen et al.

[11] Patent Number: 5,577,890

[45] Date of Patent: Nov. 26, 1996

[54] SOLID STATE PUMP CONTROL AND PROTECTION SYSTEM

[75] Inventors: Carl J. Nielsen, Saratoga, Calif.; Joseph E. Troccoli, Madison, Tenn.

[73] Assignee: Trilogy Controls, Inc., Mountain View, Calif.

[21] Appl. No.: 205,038

[22] Filed: Mar. 1, 1994

[51] Int. Cl.[6] ..... F04B 49/06

[52] U.S. Cl. ..... 417/44.2; 318/729

[58] Field of Search ..... 417/12, 17, 20, 417/43, 44.2, 53, 44.3; 318/729

[56] References Cited

U.S. PATENT DOCUMENTS

| | | | |
|---|---|---|---|
| 3,854,846 | 12/1974 | Douglas | 417/43 |
| 4,249,120 | 2/1981 | Earle | 318/729 |
| 4,281,358 | 7/1981 | Plouffe et al. | 361/22 |
| 4,329,120 | 5/1982 | Walters | 417/12 |
| 4,420,787 | 12/1983 | Tibbits et al. | 417/45 |
| 4,507,053 | 3/1985 | Frizzell | 417/43 |
| 4,642,478 | 2/1987 | Noth | 307/118 |
| 4,841,404 | 6/1989 | Marshall et al. | 417/18 |
| 4,864,287 | 9/1989 | Kierstead | 340/648 |
| 4,874,294 | 10/1989 | Karg | 417/43 |
| 5,064,347 | 11/1991 | La Valley, Sr. | 417/53 |
| 5,120,198 | 6/1992 | Clark | 417/43 |

OTHER PUBLICATIONS

Ser. No. 320,067 filed Nov. 5, 1992 Guerra et al.

PumpSaver Product Data Sheet (Models SP-11, SP-23 & SP-2315) SymCom, Inc., Rapid City, South Dakota. No Date.

Motor Saver Product Catalog, Symcom, Inc., Rapid City, South Dakota (Nov. 1991).

Subtrol-Plus Product Catalog, Franklin Electric Company, Bluffton, Indiana. No Date.

Pumptec Product Sheet, Franklin Electric Company, Bluffton, Indiana (May 1992).

Pumptec-Plus Product Sheet, Franklin Electric Company, Bluffton, Indiana (Jun. 1992).

Pump-Sentry Product Sheet (Models W-230-C & W-230-D), Spring Valley Associates, Inc., Dayton, Ohio. No Date.

MP Sentry Product Catalog, Hydrodyne Development Company, Forestville, California. No Date.

Product Sheet, Coyote Manufacturing, Inc. Tijeras, New Mexico (Summer 1988).

*Primary Examiner*—Timothy S. Thorpe
*Assistant Examiner*—Xuan M. Thai
*Attorney, Agent, or Firm*—Donald J. Pagel

[57] ABSTRACT

A pump control and protection system comprised of an analog module and a digital module. The analog module includes a synchronous phase detector, a pressure transducer and an over voltage/under voltage circuit. The synchronous phase detector determines the phase angle between a current signal supplied to a water pump and a voltage signal supplied to the pump. The output of the phase detector is directed to a programmable array logic device in the digital module and used to activate a solid state relay that controls the power supplied to the pump. The water pressure in the system is displayed on a digital display.

25 Claims, 7 Drawing Sheets

SOLID STATE PUMP CONTROL AND PROTECTION SYSTEM

TECHNICAL FIELD

The present invention relates to a control system for protecting a pump used with water wells and more particularly to a control system that utilizes the phase angle relationship between the AC current and voltage to the pump, and the relationship between pressure in the system and time, to monitor the condition of the pump.

BACKGROUND ART

Many households outside of urban or suburban areas are not connected to public drinking water systems. Instead, they depend on water supplied by a well. Typically, a submersible pump in the one horsepower range is submerged in the well and used to pump water from the well up to a house or other site. Nonsubmersible or "jetpumps," which pump water down into the well in order to force water out of the well are also used, as are other types of nonsubmersible pumps.

In a typical system, a pressure tank is used for storing a certain amount of water pumped from the well. The pressure tank is pressurized with air and connected between the pump and the house to provide a reservoir of pressurized water to the house, thereby minimizing the number of pump starts by extending the pump "on" time. The pump (or a pump starter box) is connected to an AC power supply via a mechanical pressure switch working as a control unit. The mechanical pressure switch is also connected to the pressure tank. A pressure gauge connected to the mechanical pressure tank is used to monitor the water pressure coming from the pressure tank. When this water pressure drops below a certain level, the control system activates the pump submerged in the well, which causes additional water to be pumped from the well to the pressure tank.

Pumps used in this manner are vulnerable to many types of problems. For example, if the well runs dry for any reason, the pump will quickly overheat and burn up as it tries to pump nonexistent water to the pressure tank. Similarly, if the pressure tank looses air pressure, a condition referred to as rapid cycle begins in which the pump turns on and off repeatedly over a short period of time. Ideally, the number of pump starts should be limited to about thirty per day and the pump "on" time should be longer than one minute. More than about three hundred starts per day for a three quarter horsepower pump will result in marked deterioration of the pump. Additionally, either undervoltage or overvoltage fluctuations in the AC power supply can cause the pump to burn up.

When a pump burns up, regardless of the reason, the pump has to be replaced. With submersible pumps, pump replacement usually entails digging up the well in addition to acquiring a new pump. Therefore, this is a relatively expensive and time consuming repair.

The pump control system of the present invention minimizes pump problems due to the low water condition, the rapid cycle condition and the undervoltage and overvoltage conditions, and also permits use of a simplified installation process for installing the pump control system.

SUMMARY OF THE PRESENT INVENTION

Briefly, a preferred embodiment of the present invention comprises a pump control and protection system that uses the phase angle relationship between the alternating current (AC) supplied to a water pump and the voltage supplied to the pump, as well as relationships with pressure and time, to monitor the condition of the pump.

It has been determined that when the pump is operating normally, the current signal lags the voltage signal by about forty-five degrees. When the pump is overloaded, such as when a bearing freezes or the motor shaft can't turn, or when there is an electrical short in the pump, the current signal and the voltage signal are approximately in phase. When the pump is experiencing an underload situation, such as when there is not enough water in the well to be pumped, or when an air or gas lock develops in the pump, the current signal lags the voltage signal by about ninety degrees. Therefore, the phase angle between the current and voltage signals provides the information required to monitor the condition of the pump.

The pump control and protection system of the present invention comprises an analog module and a digital module. A current transformer extracts the AC current signal from an electrical line that supplies power to the water pump and feeds the current signal into a phase detector in the analog module. A voltage signal is extracted from an electrical line that supplies power to the water pump and is fed to the phase detector where the amplitude of the voltage signal is modified in response to the amplitude of the current signal.

The modified amplitude of the voltage signal is filtered and fed to a comparator circuit that compares the filtered signal to reference signals. The outputs from the comparator circuit is fed to the digital module. The digital module includes a programmable array logic (PAL) device that controls the supply of power to the pump by activating a solid state relay in response to the output from the comparator circuit.

The pump control system also includes a semiconductor pressure transducer that measures the pressure of water pumped by the pump. The water pressure information is inputted to the digital module for display on an LED display and for use by the PAL device. The pump control system also includes an over voltage/under voltage circuit for determining when the power supply to the pump is not optimal.

The PAL device includes an internal clock that is used to time the length of time that the relay is on and the length of time that it takes for the water pressure to increase. The internal clock also provides the timing for the automatic "on/off" sequencing of the pump through the relay control during low water conditions.

DETAILED DESCRIPTION OF THE PREFERRED EMBODIMENT

Figure 1:
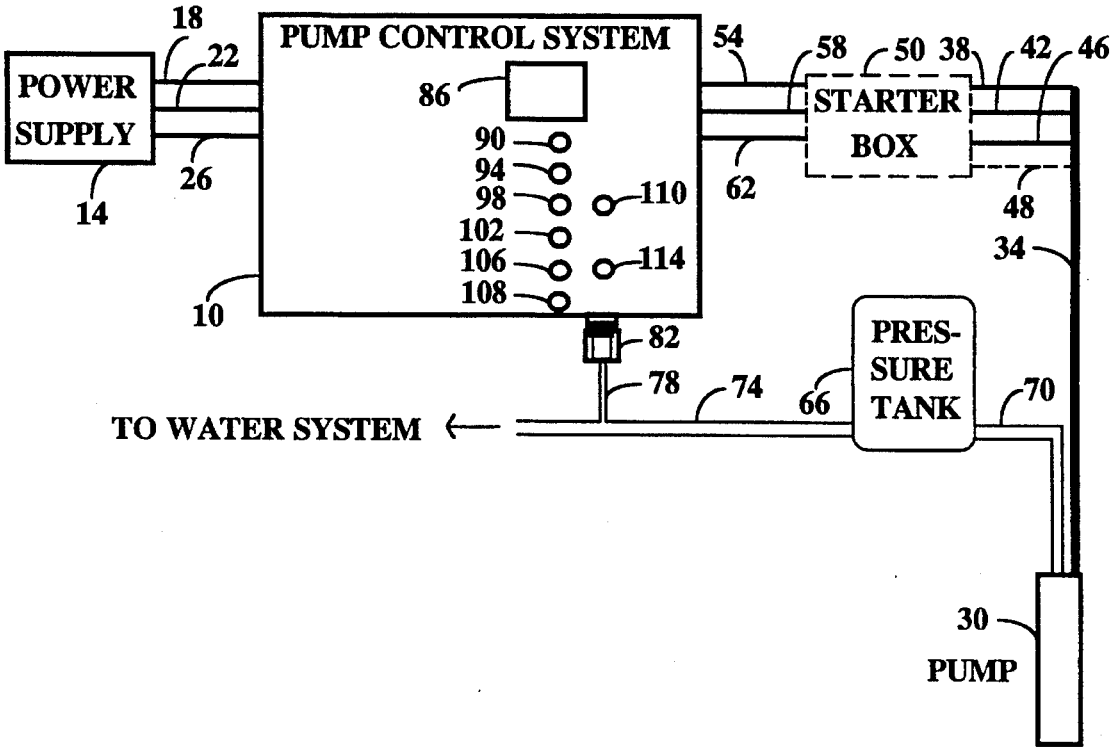
FIG. 1 is a schematic diagram of a pump control and protection system according to the present invention.

FIG. 1 is a schematic diagram of a pump control and protection system 10. The system 10 is electrically connected to a power supply 14, such as a 230 volt alternating current (AC) power supply, by three electrical lines: line 18, line 22 and line 26 (which is ground). A pump 30 is electrically connected to the pump control system by a pump cable 34 which connects the pump 30 to an electrical line 38, an electrical line 42 and an electrical line 46 (which is ground). The pump 30 may be any type of electrical pump for pumping liquids. In the preferred embodiment, the pump 30 is a water pump such as a 230 volt AC two or three wire submersible water pump in the one tenth to three horsepower range. A nonsubmersible pump or a jet pump in a similar power range could also be used. Typically, the pump 30 is a single phase motor, but it may also be a three phase motor.

The electrical lines 38, 42 and 46 and an electrical line 48 are electrically connected directly to a starter box 50. The starter box 50 is electrically connected to the pump control system 10 by an electrical line 54, an electrical line 58 and an electrical line 62 (which is ground).

The starter box 50 is a device used with three wire pumps to assist in starting the pump 30. The electrical line 48 functions to connect a starter capacitor in the starter box 50 to the pump 30. With two wire pumps, a starter is built into the pump 30 and the starter box 50 is not required. If the starter box 50 is not used, the electrical lines 38, 42 and 46 are electrically connected directly to the pump control system 10 and the electrical lines 54, 58, 62 and 48 are eliminated.

The pump 30 is connected to a pressure tank 66 by a first water line 70. A second water line 74 connects the pressure tank 66 to a water system such as the plumbing system in a residential house. A third water line 78, such as a piece of one-quarter inch copper tubing, connects the second water line 74 to the pump control system 10. A compression fitting 82 provides a water tight connection between the pump control system 10 and the water line 78.

The face of the pump control system 10 includes a digital display 86, such as a two digit LED display, on which a digital readout of the water pressure in the water line 74 is displayed. The face of the pump control system 10 also includes a plurality of light emitting diodes (LED) for indicating the operating status of the pump 30. A red LED 90 indicates a low water status; a red LED 94 indicates an overload status; a red LED 98 indicates a rapid cycle status; a red LED 102 indicates an undervoltage status; a red LED 106 indicates an overvoltage status; a red LED 108 indicates an abnormal flow status; and a green LED 110 indicates that the pump 30 is on. A reset button 114 is provided for resetting the system 10 to an initial "normal" configuration.

Figure 2:
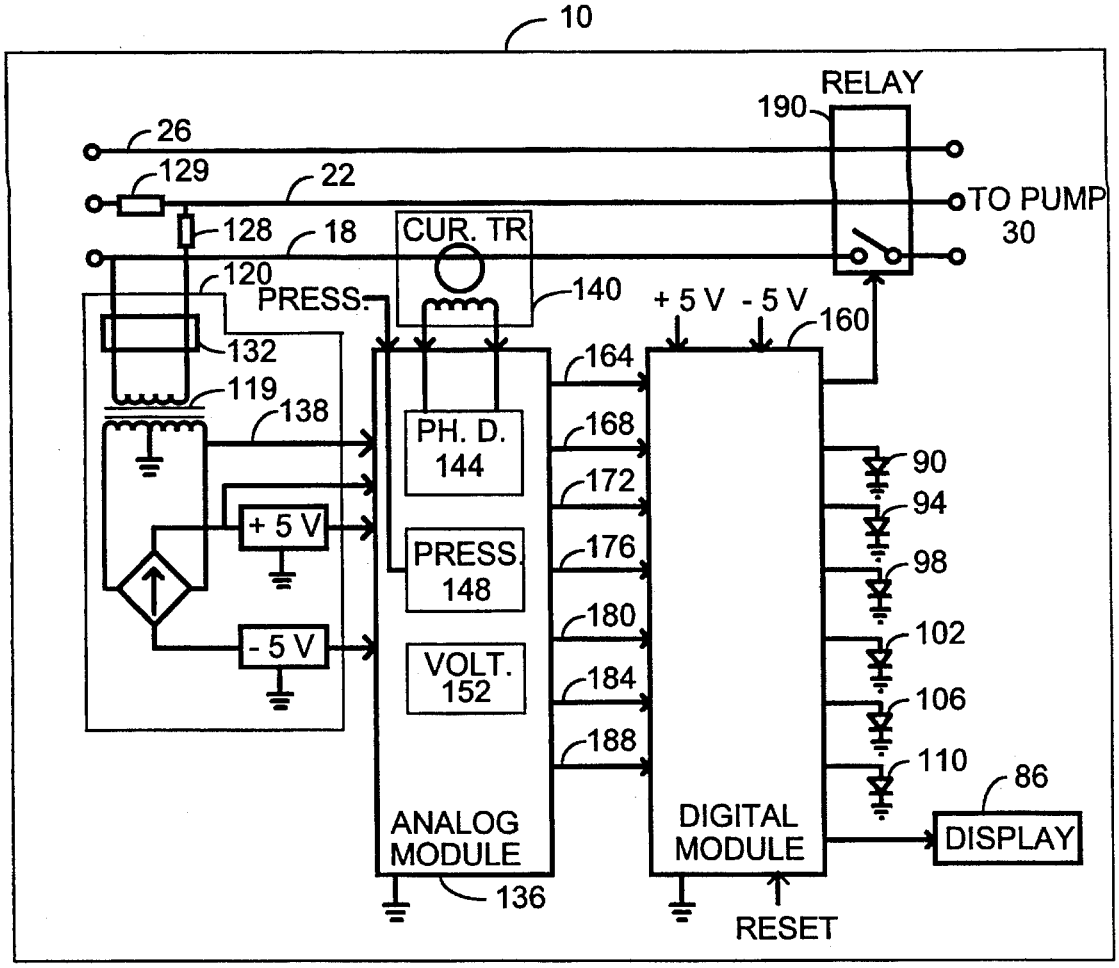
FIG. 2 is a block diagram of the electrical components in the pump control and protection system of the present invention.

FIG. 2 is a block diagram that illustrates the basic electrical components of the pump control system 10. The electrical line 22 is connected to a power supply transformer 119 that forms part of an internal power supply 120. A pair of safety fuses 128 and 129 are inserted in the electrical path between the power supply 14 and the transformer 119 for protection. A radio frequency filter 132 filters electrical transients from external power and from internal noise. The transformer 119 reduces the line voltage to a lower control voltage and generates a plus and minus five volt power supply for the system 10. The voltage signal from the line 22 is also inputted into an analog module 136 by a lead 138.

A current transformer 140 (for example, an iron core with windings), extracts information about electrical current flowing in the electrical line 18 and provides it to the analog module 136. The analog module 136 comprises a plurality of circuits for analyzing information about the status of the pump 30. More specifically, the analog module 136 includes a synchronous phase detector 144 for determining the phase shift of current flowing in the electrical line 18 relative to the voltage in electrical line 22. A pressure transducer 148 determines the pressure in the water line 74 and a voltage detector 152 determines when an under voltage or over voltage situation occurs.

The output from the analog module 136 is directed to a digital module 160 by a plurality of electrical leads. A lead 164 carries information about an overload ("short") condition in the pump 30; a lead 168 carries information about a low water condition; a lead 172 carries information from the transducer 148 for displaying the water pressure on the display 86; a lead 176 carries information about the waller pressure in the water line 74 is higher or lower than a preset range; a lead 180 carries information about an over voltage situation; a lead 184 carries information about an under voltage situation; and a lead 188 carries information about minimum pressure. The digital module 160 processes the analog output to yield information about the status of the pump 30 by activating the LEDs 90, 94, 98, 102, 106, 108 or 110, and to display the water pressure in the water line 74 as a digital read-out on the display 86.

The digital module 160 is also programmed to send a signal to a relay 190 under certain predetermined conditions that causes the relay 190 to turn on or to cut off power to the pump 30. In the preferred embodiment, the relay 190 is a solid state component that switches at zero crossings, such as the 240 volt/25 amp. part available from Crydom Company of Long Beach, Calif. (part no. D2425) or Gordos, Inc. of Rogers, Ariz. (part no. G280D25).

The term switching at zero crossings means that when the relay 190 receives a control signal to turn the pump 30 on or off, the relay 190 waits until the AC voltage on the relay 190 is zero before executing the control signal. The use of the indicated solid state relay is preferable to the use of a mechanical relay because switching at zero crossings greatly reduces the chance of problems like electrical arcing and therefore preserves the life of the relay 190 relative to that of a mechanical relay. The use of the solid state relay also provides gentler starts and stops of the pump 30, thereby prolonging the life of the pump motor. A varistor may be included in the relay 190 to protect the relay 190 against high voltage transients from external sources.

Figure 3:
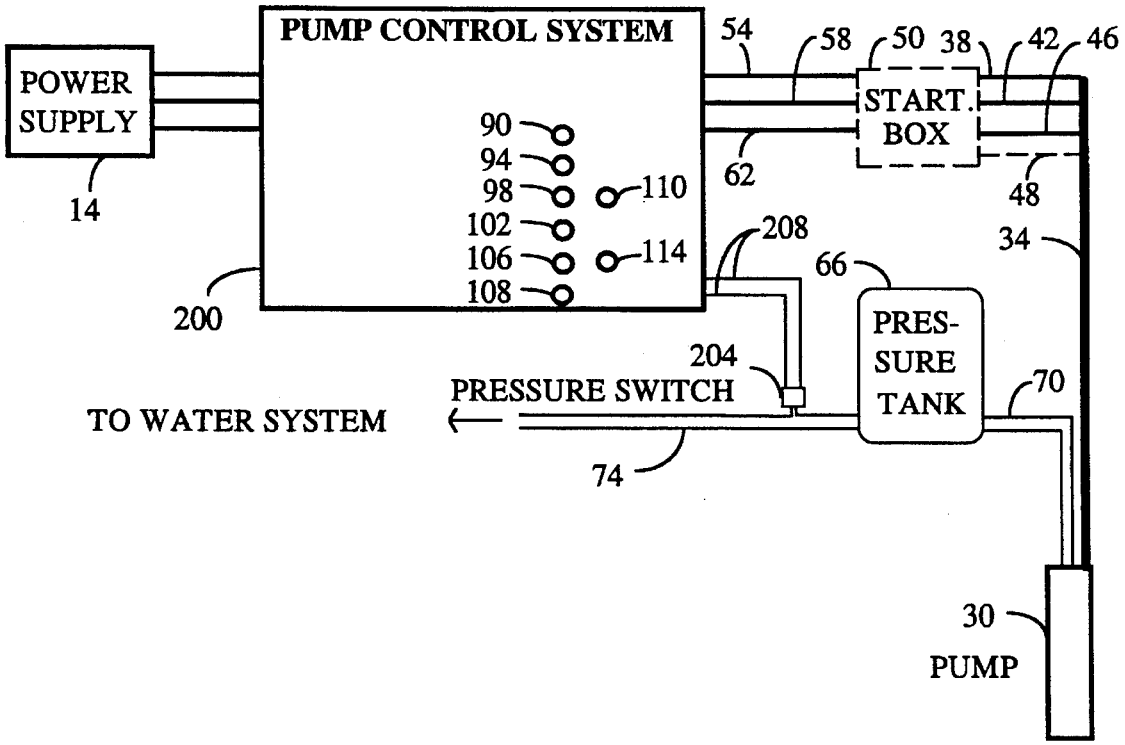
FIG. 3 is a schematic diagram of a pump control and protection system according to an alternative embodiment of the present invention.

FIG. 3 is a schematic diagram of a pump control and protection system 200 which is an alternative embodiment of the pump control and protection system 10. Elements of the system 200 which are identical to elements in the system 10 are indicated by the same reference numbers used with respect to the system 10.

The system 200 is connected to a pressure switch 204 by a pair of electrical leads 208. The pressure switch 204 is connected to the second water line 74. The pressure switch 204 is an electromechanical switch operated by the pressure in line 74. The system 200 does not include the digital display 86 or the pressure transducer 148.

Figure 4A:
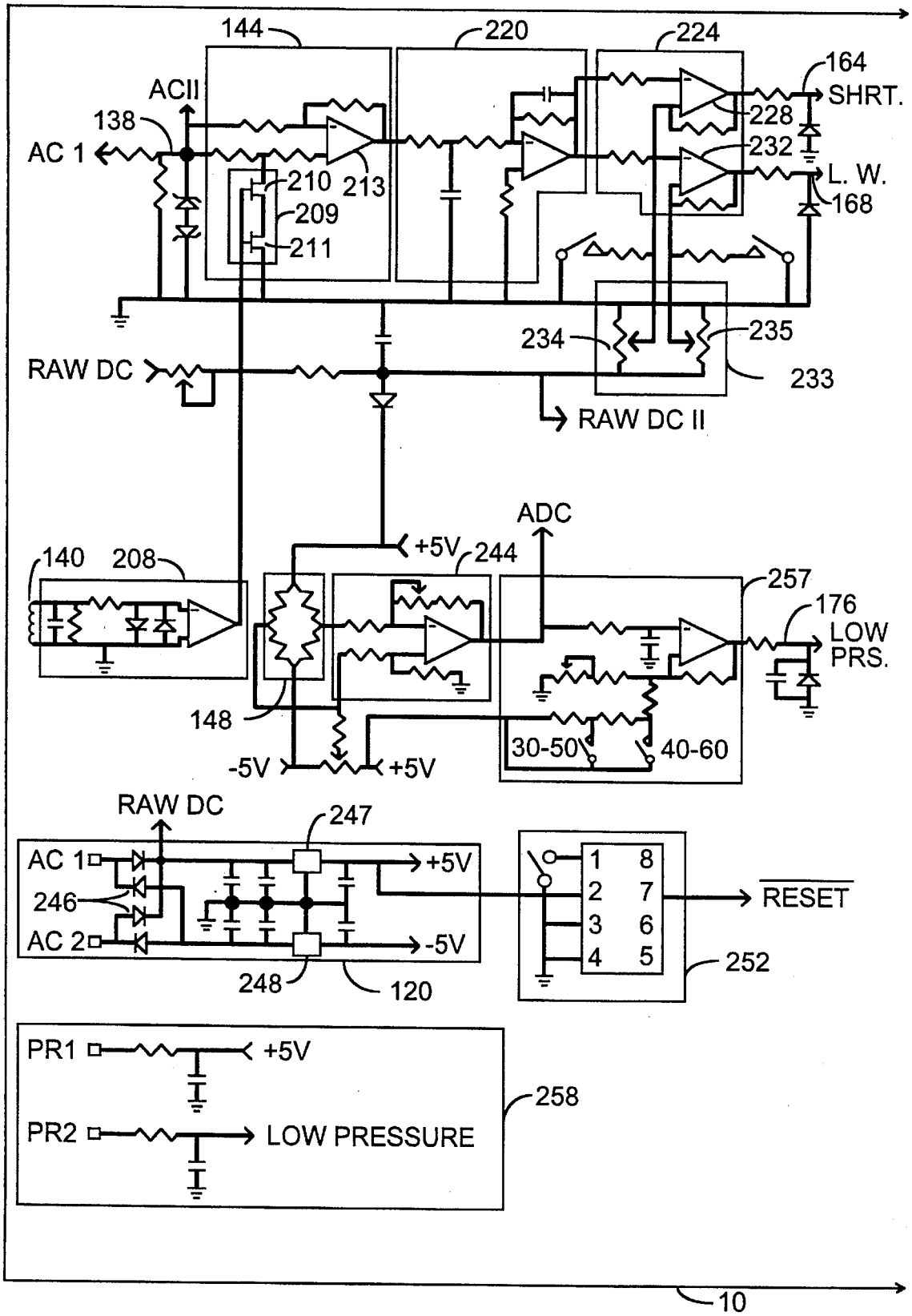
FIG. 4 is a circuit diagram of the electrical components in the pump control and protection system of the present invention.
Figure 4B:
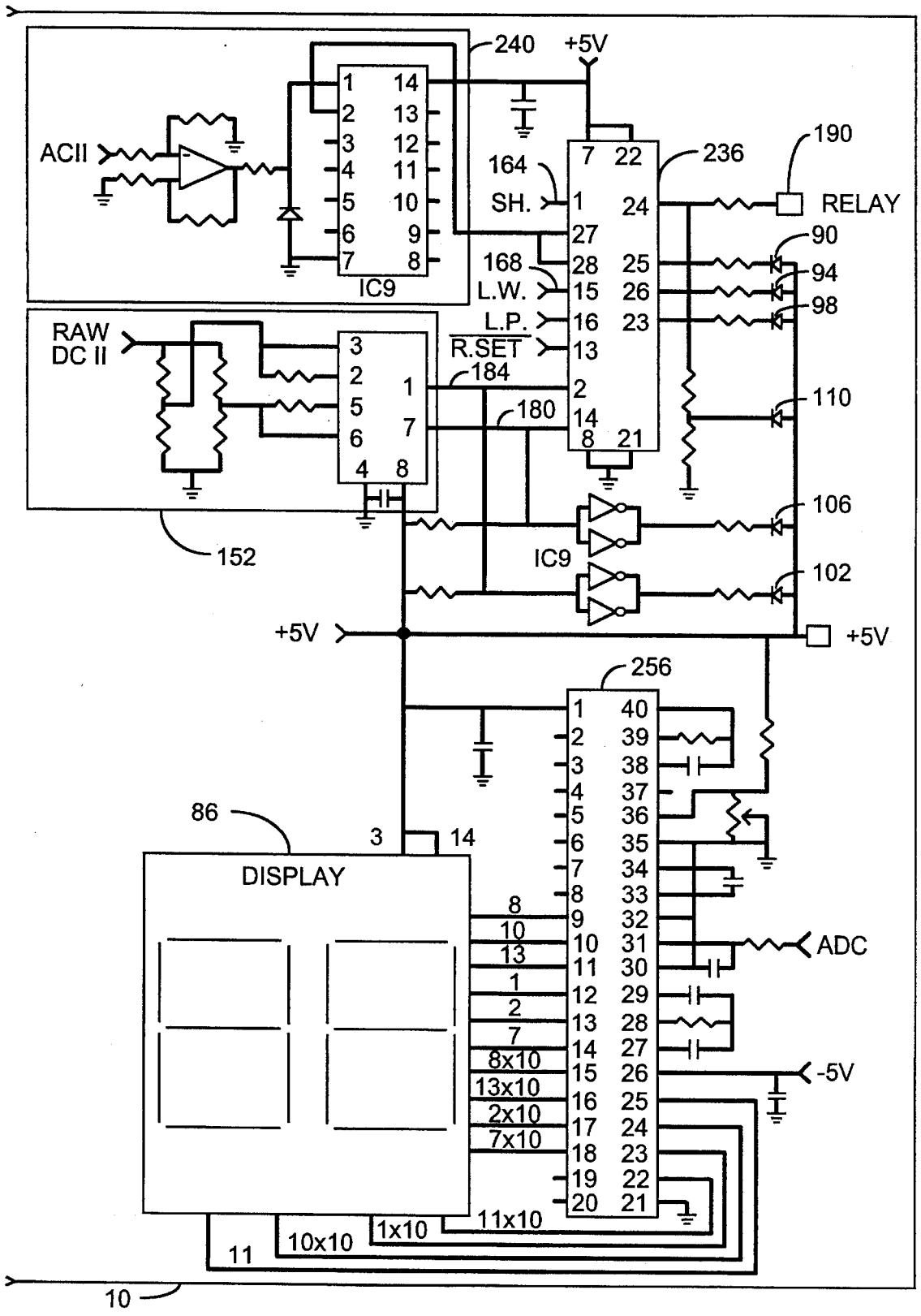

FIG. 4 is a circuit diagram illustrating the electrical components of the system 10 in more detail. The current transformer 140 is connected to a current detector 208 which is connected to a switch 209 within the phase detector 144. The switch 209 is comprised of a pair of FET transistors 210 and 211 that are connected in series so as to assure nonconductance during turn-off of the transistors. The switch 209 sets the gain of an operational amplifier 213 within the phase detector 144.

An active filter 220 is connected between the phase detector 144 and a comparator circuit 224 comprised of a pair of operational amplifiers 228 and 232. A reference circuit 233, comprised of a pair of potentiometers 234 and 235, sets the gain of the operational amplifiers 228 and 232. The output of the comparator circuit 224 is directed to a logic circuit 236 which also receives the output of a clock driver 240 and the over voltage/under voltage detector 152, as well as the output from the pressure transducer 148 after it has been amplified by a preamplifier 244.

In the preferred embodiment, the pressure transducer 148 is an integrated circuit comprised of a four resistor bridge implanted on a silicon membrane, such as part no. 24PCGFM1G available from Micro Switch of Freeport, Ill. The logic circuit 236 is a programmable array logic device (PAL) such as part no. EPM5032-25, available from Altera of San Jose, Calif. The over voltage/under voltage detector 152 comprises an integrated circuit such as part no. ICL7665CPA available from Maxim of Sunnyvale, Calif.

The power supply transformer 119 functions to reduce the 230 V line voltage to a safer level and supply the plus and minus five volt supplies for the system 10. In the preferred embodiment, the internal power supply 120 includes a plurality of diodes 246, a plus five volt regulator 247 and a minus five volt regulator 248.

A reset chip 252 functions to reset the logic circuit 236 to the beginning of the "normal" sequence identified in Example 1 below. The reset chip 252 is activated by depressing the reset button 114. The systems 10 and 200 are also reset by turning off the power to the system 10 or 200.

The display 86 is connected to a display driver 256 that includes an analog to digital converter. The digital module 160 comprises the logic circuit 236 and the display driver 256.

A comparator circuit 257 compares the output from the transducer 148, as amplified by the preamplifier 244, to a switch selectable reference. By adding positive feedback to the comparator circuit 257, a range is obtained instead of a single switch value.

The system 200 utilizes the same electronic circuitry illustrated in FIG. 4 except that the system 200 does not include the pressure transducer 148, the display 86 and the display driver 256, and the components associated with these parts. The pressure switch 204 is electrically connected to the system 200 so that a low or high water pressure signal (corresponding to the water pressure in the line 74) is inputted to the logic circuit 236. An input circuit 258, which is only present in the system 200, functions to supply a pressure signal from the pressure switch 204 to the logic circuit 236. In the system 200, the LED 110 indicates that power is on in the system 200.

Figure 5A:
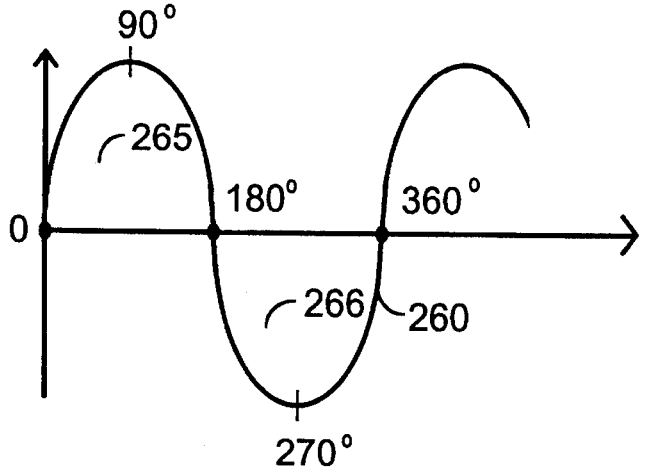
FIG. 5 is a schematic representation of the voltage and current waveforms used in the present invention.
Figure 5B:
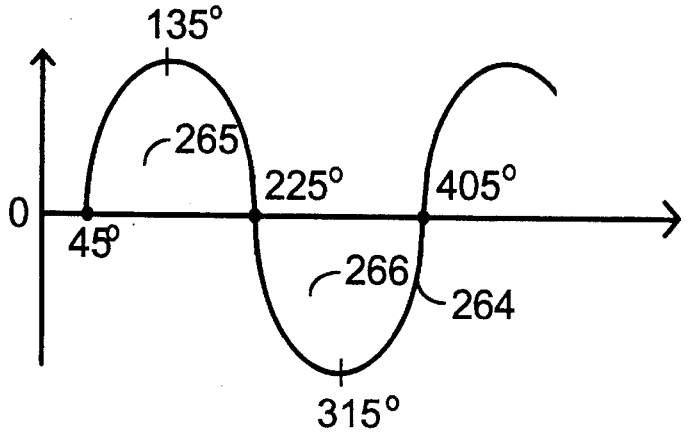
Figure 5C:
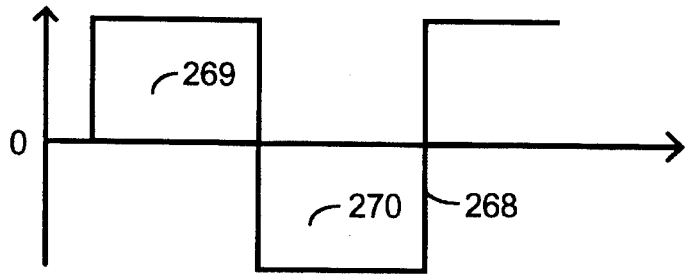

FIG. 5 illustrates the signals used in calculating the phase angle between the current and voltage signals. An AC voltage signal 260 (FIG. 5(*a*)) and an AC current signal 264 (FIG. 5(*b*)) both have sinusoidal shapes that include positive areas 265 and negative areas 266. The positive areas 265 mean the amplitude component is above the zero volt or ampere line and the negative areas 266 mean that the amplitude of the wave is below the zero volt or ampere line. In FIG. 5, the current signal 264 is depicted as lagging the voltage signal 260 in phase by approximately forty-five degrees.

The current signal 264 is processed to yield a square wave signal 268 that has a uniform positive amplitude 269 whenever the current signal 264 has a positive amplitude, and has a uniform negative amplitude 270 whenever the current signal 264 has a negative amplitude. The phase of the square wave signal 268 exactly mirrors the phase of the current signal 264.

Figure 6:
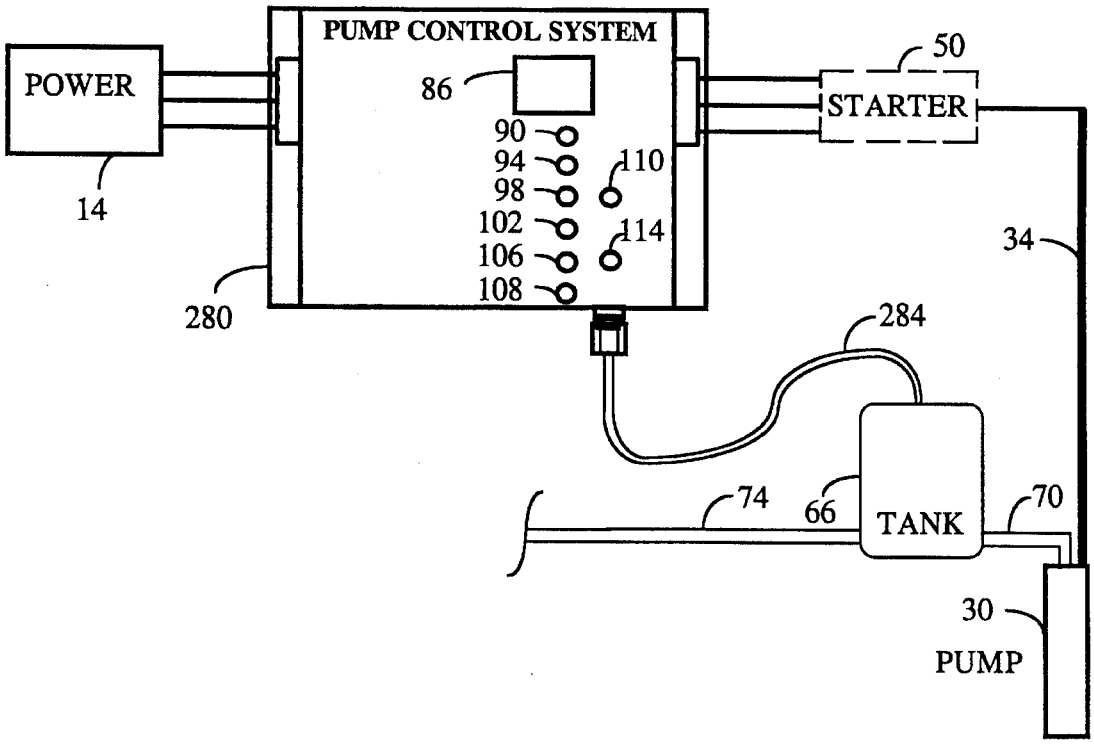
FIG. 6 is a schematic diagram of a pump control and protection system according to an alternative embodiment of the present invention.

FIG. 6 is a schematic diagram of a pump control system 280 which is an alternative embodiment of the pump control system 10. Elements of the pump control system 280 which are identical to elements in the pump control system 10 are indicated by the same reference numbers used with respect to the system 10. The system 280 utilizes the same electronic circuitry illustrated in FIG. 4 as described previously.

The system 280 is connected to the pressure tank 66 by a pressure hose 284. The pressure hose 284 is connected to the pressurized air supply in the pressure tank 66 and to the pressure transducer 148 (shown in FIG. 4) in the system 280. This allows the transducer 148 to measure the pressure in the tank 66 instead of the water pressure in the line 74.

Referring now to FIGS. 1–6, the functioning of the present invention can be explained. It was determined empirically, that when the pump 30 is operating normally, the current signal 264 lags the voltage signal 260 by about forty-five degrees. When the pump 30 is overloaded, the current signal 264 and the voltage signal 260 are approximately in phase. When the pump 30 is experiencing an underload situation, the current signal 264 lags the voltage signal 260 by about ninety degrees. Therefore, the output of the active filter 220 varies with the phase angle signal, and can be used to generate the pump "idle" (low water or underload condition) and pump "short" (overload condition) signals that are passed to the logic circuit 236.

The signals 260, 264 and 268 are generated as follows: The current transformer 140 is inductively coupled to the electrical line 18. The current transformer 140 extracts the current signal 264 from the line 18 and passes it to the current detector 208 which processes the signal 264 to yield the square wave signal 268 which is inputted to the switch 209. When the square wave signal 268 has a positive amplitude (i.e. region 269 in FIG. 5), the transistors 210 and 211 are closed, and the gain of the amplifier 213 is set to −1. When the square wave signal 268 has a negative amplitude (i.e. region 270 in FIG. 5), the transistors 210 and 211 are off, and the gain of the amplifier 213 is set to +1.

The voltage signal 260 from the electrical line 138 is inputted into the operational amplifier 213. The amplitude of the voltage signal 260 is modified by the gain of the operational amplifier 213 (essentially it is multiplied by the gain to yield a "phase modified voltage signal"). The phase modified voltage signal (i.e. the output of the operational amplifier 213) is passed to the active filter 220 which filters out the AC component of the phase modified voltage signal to yield a DC-like signal referred to as the "filter output signal." In the preferred embodiment, the filter output signal will have a value of approximately 3.5 volts for the "short" condition (i.e. when the signals 260 and 264 are in phase). For the "normal" condition (i.e. when the signals 260 and 264 are forty-five degrees out of phase), the filter output signal will have a value of approximately 2.5 volts. For the "low water" condition (i.e. when the signals 260 and 264 are ninety degrees out of phase), the filter output signal will have a value of approximately 0.5 volts.

The filter output signal is passed to the comparator 424. If the filter output signal is high (i.e. above about 3.0 volts), the operational amplifier 228 passes a "short" signal to the logic circuit 236. If the DC output from the filter 220 is low (i.e. below about 1.2 volts), the operational amplifier 232 passes a "low water" (pump idle) signal to the logic circuit 236. If the filter output signal is between 1.2 volts and 3.0 volts, no signal is passed by the comparator 224, thereby indicating a "normal" condition to the logic circuit 236. The reference levels for the operational amplifiers 228 and 232 are set by the potentiometers 234 and 235, respectively. As indicated in FIG. 4, the raw DC voltage is inputted into the potentiometers 234 and 235 in order to supply reference levels scaled to the input AC voltage 260 in order to cancel the effect of AC power supply voltage variations.

In the preferred embodiment, the logic circuit 236 is a programmable array logic (PAL) device that is programmed to turn the solid state relay 190 and the LEDs 90, 94, 98, 102, 106, 108 and 110 on and off in response to different control signals (see Examples 1–5 below). The logic circuit 236 also includes internal clock circuits for performing the various timing functions described in Examples 1–5. It should be appreciated that other types of logic devices such as a microprocessor or an application specific integrated circuit (ASIC) could also be used as the logic circuit 236.

The pressure transducer 148, in conjunction with the signal conditioning circuit 244, functions to generate an analog voltage that is proportional to the water pressure in the second water line 74. Basically, the pressure transducer 148 comprises a four resistor bridge implanted in a silicon membrane. The silicon membrane bends in response to pressure changes thereby changing the resistance in the four resistor bridge. The analog water pressure signal is converted to a digital signal by the analog to digital converter in the display driver 256 and is displayed in digital form on the display 86.

The analog water pressure signal is also compared with set reference voltages in the comparator 257 to generate a low, or high water pressure signal that is inputted to the logic circuit 236. For example, a dual switch on the system 10 allows the pressure range to be preset to one of three ranges: 20–40 pounds per square inch (lbs/sq.in.), 30–50 lbs:/sq.in., or 40–60 lbs/sq.in.

The overvoltage/undervoltage circuit 152 functions to generate overvoltage/undervoltage signals for the logic circuit 236 and for the overvoltage/undervoltage LED's 102 and 106.

The clock driver circuit 240 functions to provide the sixty cycle input for the timer circuits in the logic circuit 236.

The power supply transformer 122 functions to lower the voltage to a value more suited for the system 10 or 200.

The functioning of the pump control and protection system 10 is summarized by the following examples:

EXAMPLE 1

Normal Functioning

If the pump 30 is operating normally, the following sequence of events occurs in the pump control system 10:

1. Power is on to the system 10; Power is on to the reset circuit 252; and LED 110 is off.

2. If a low water pressure signal is received in the logic circuit 236 and no short, high voltage, low voltage, pump idle or low water timer signals are received in the logic circuit 236, then the relay 190 and LED 110 are turned on in response to a control signal generated by the logic circuit 236, thereby activating the pump 30.

3. If a high water pressure signal is received in the logic circuit 236 and no short, high voltage, low voltage, pump idle or low water timer signals are received in the logic circuit 236, then the relay 190 is turned off in response to a control signal generated by the logic circuit 236, thereby deactivating the pump 30.

EXAMPLE 2

"Short" Condition, "High Voltage" Condition and "Low Voltage" Condition

1. If the pump 30 experiences a "short" condition (i.e. if the pump 30 is overloaded such as when a bearing freezes or the motor shaft can't turn; or when there is an electrical short in the pump 30 or in its wiring, such as the pump cable 34), a "short" signal is received by the logic circuit 236 and the following sequence of events occurs in response to control signals generated by the logic circuit 236: the relay 190 is turned off, the LED 94 is turned on, and the relay 190 stays off until the reset button 114 is pressed.

2. If the pump 30 experiences a "high voltage" condition, an "overvoltage" signal is received by the logic circuit 236 and the following sequence of events occurs in response to control signals generated by the logic circuit 236: the relay 190 is turned off, the LED 106 is turned on. The relay 190 stays off and the LED 106 stays on until the voltage returns to normal.

3. If the pump 30 experiences a "low voltage" condition, an "undervoltage" signal is received by the logic circuit 236 and the following sequence of events occurs in response to control signals generated by the logic circuit 236: the relay 190 is turned off, the LED 102 is turned on. The relay 190 stays off and the LED 102 stays on until the voltage returns to normal.

EXAMPLE 3

Low Water (Pump Idle) Condition

If the pump 30 experiences a low water condition (i.e. if the pump 30 is underloaded such as when there is not enough water in the well to be pumped; or when an air or gas lock develops in the pump 30), a "low water" signal is received by the logic circuit 236 and the following sequence of events occurs in response to control signals generated by the logic circuit 236:

1. The relay 190 is turned off, a five minute timer is started and the LED 90 is turned on. After five minutes, the relay 190 is turned on and:

a) if the water pressure is high, the relay 190 is turned off, the LED 90 is turned off and the system 10 returns to the normal condition of Example 1.

b) if the pump idle condition still exists, the relay 190 is turned off and a thirty minute timer is started. After thirty minutes, the relay 190 is turned on and:

c) if the water pressure is high, the relay 190 is turned off, the LED 90 is turned off and the system 10 returns to the normal condition of Example 1.

d) if the pump idle condition still exists, the relay 190 is turned off and a sixty minute timer is started. After sixty minutes, the relay 190 is turned on and:

e) if the water pressure is high, the relay 190 is turned off, the LED 90 is turned off and the system 10 returns to the normal condition of Example 1.

f) if the pump idle condition still exists, the relay 190 is turned off and a sixty minute timer is started. After sixty minutes, the relay 190 is turned on and steps "e" and "d" are repeated until a normal condition is detected.

EXAMPLE 4

Rapid Cycle Condition

Rapid cycle is an undesirable condition in which the pump 30 is turning on and off repeatedly over a short period of time, for example because the pressure tank 66 is not the correct size, or because the air volume in the pressure tank 66 is too low. If the pump 30 experiences a rapid cycle condition, the condition is detected by the logic circuit 236 as described below and the following sequence occurs:

1. If the current to the pump 30 is on for less than one minute but more than thirty seconds during the normal cycle, the LED 98 flashes on and off until the reset button 114 is depressed. Therefore, this sequence notifies the pump user that a mild rapid cycle condition occurred, and but does not shut off the pump 30.

2. If the current to the pump 30 is on for less than thirty seconds during the normal cycle, the LED 98 turns on solid and the relay 190 is turned off. The LED 98 remains on and the relay 190 remains off until the reset button 114 is depressed.

The logic circuit 236 uses the internal clock to time the period that current is flowing to the pump and uses the control signal generated by the logic circuit 236 for the relay 190 to determine when current is flowing. The logic circuit 236 also has a one second delay programmed into it that causes the logic circuit 236 to recheck a low or high pressure reading before turning the pump 30 on or off. This reduces the likelihood of turning the pump 30 on or off because of transient fluctuations in water pressure in the second water line 74.

EXAMPLE 5

Nonflow (Dead Head) Conditions

Nonflow in a pumping system (also known as dead head, dry running or gas or air lock) is a condition caused by any type of blockage that prevents or substantially restricts the flow of water in the water lines 74 or 70 at any point on the head side of the pump 30, while the pump 30 is running. For example, a nonflow condition exists when the water line 74 freezes, or when an air or gas bubble forms in the pump 30.

The nonflow condition is detected by programming the logic circuit 236 to monitor the water pressure signal inputted to the logic circuit 236 while simultaneously running a clock cycle (using the internal clock in the logic circuit 236) to determine the period of time that the pump 30 has been on. If the water pressure does not build up to a preset level (e.g. 15 PSI) after the pump has been on for a preset period of time (e.g. one minute), then the logic circuit 236 turns off the pump 30 by opening the relay 190.

A nonflow condition can also be detected by inputting the flow signal from a flow detector into the logic circuit 236, instead of the water pressure signal described above.

EXAMPLE 6

Functioning of Systems 200 and 280

The systems 200 and 280, illustrated in FIGS. 3 and 6, include circuitry similar to that of the system 10 and therefore function similarly to the system 10. For example, the systems 200 and 280 detect the "normal," "short," "low water," "rapid cycle,", "high voltage" and "low voltage" conditions in the same manner as the system 10. However, in the system 200 the high or low water pressure signals are inputted to the logic circuit 236 from the pressure switch 204 instead of from the transducer 148, or from, for example, a level switch in a tank 66.

In the system 280, the pressure of the air in the tank 284 is inputted to the transducer 148. By measuring air pressure instead of water pressure, the problem of water freezing in the line 78 is eliminated.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A pump control system comprising:

a synchronous phase detector for generating a first output signal related to a phase shift between an AC current signal supplied to a pump and a voltage signal supplied to the pump, the first output signal comprising a full cycle of the voltage signal as modified by the polarity of the amplitude of the AC current signal, the synchronous phase detector comprising a first operational amplifier for generating the first output signal; and a switch means for receiving polarity information about the AC current signal and for adjusting the gain of the first operational amplifier in response to the polarity information;

a filter means for generating a filtered signal derived from the first output signal;

a comparator means for generating a second output signal based on a comparison of the filtered signal to a reference value;

a logic means for receiving the second output signal and generating a control signal; and a relay means for turning power to the pump on or off in response to the control signal.

2. The pump control system of claim 1 wherein the relay means comprises a solid state relay that switches at zero crossings.

3. The pump control system of claim 1 further comprising:

a connection means for connecting a pump control system to a line carrying a liquid pumped by the pump, the liquid filling the connection means at the same pressure as is present in the line; and a transducer means electrically connected to the pump control system for generating a signal that is proportional to the pressure of the liquid in the connection means.

4. The pump control system of claim 3 further comprising:

a display means electrically connected to the transducer means for displaying the pressure of the liquid in the connection means.

5. The pump control system of claim 1 further comprising:

first coupling means for inductively coupling a first electrical line to the pump control system and for providing the AC current signal to the pump control system; and second coupling means for inductively coupling a second electrical line to the pump control system and for providing the voltage signal to the pump control system.

6. The pump control system of claim 1 wherein the logic means is selected from the group consisting of a programmable array logic device, an application specific integrated circuit and a microprocessor.

7. The pump control system of claim 1 wherein the comparator means comprises a second operational amplifier and a third operational amplifier.

8. A water pump control system comprising:

a current transformer means for extracting a first current signal from a first electrical line that supplies power to a water pump;

a current detector means for processing the first current signal to yield a second current signal whose amplitude is related to the sign of the amplitude of the first current signal;

a synchronous phase detector means for generating a first output signal related to a phase shift between the second current signal and a voltage signal taken from a second electrical line that supplies power to the pump, the first output signal comprising a full cycle of the voltage signal as modified by the second current signal, the synchronous phase detector comprising a first operational amplifier for generating the first output signal; and a switch means for receiving polarity information about the second current signal and for adjusting the gain of the first operational amplifier in response to the polarity information;

a filter means for generating a filtered signal derived from the first output signal;

a comparator means for comparing the filtered signal to a reference value and generating a second output signal based on the comparison of the filtered signal to the reference value;

a logic means for processing the second output signal to yield a control signal; and a relay means for turning power to the pump on or off in response to the control signal.

9. The water pump control system of claim 8 wherein the switch means comprises at least one transistor.

10. The water pump control system of claim 8 wherein the logic means comprises at least one integrated circuit.

11. The water pump control system of claim 8 further comprising:

a connection means for connecting the water pump control system to a water line carrying water pumped by the pump, the connection means being filled with water at the same pressure, as is present in the water line; and a transducer means electrically connected to water pump control system for generating a signal that is proportional to the pressure of water in the connection means.

12. The water pump control system of claim 11 wherein the transducer means comprises an integrated circuit.

13. The water pump control system of claim 11 further comprising:

a display means for displaying the pressure of water in the connection means.

14. The water pump control system of claim 13 wherein the display means comprises a digital display.

15. The water pump control system of claim 8 further comprising:

a voltage detection means for detecting an overvoltage or undervoltage condition in a power supply that supplies power to the pump.

16. The water pump control system of claim 8 wherein the logic means includes an internal clock for measuring periods of time.

17. The water pump control system of claim 8 wherein the relay means comprises a solid state relay having switching at zero crossings.

18. The water pump control system of claim 8 further comprising:

a pressure line connection means for connecting the water pump control system to a source of pressurized air; and a transducer means for measuring an air pressure value in the pressure line connection means.

19. The water pump control system of claim 8 wherein the comparator means comprises a second operational amplifier and a third operational amplifier.

20. A water pump control system comprising:

a current transformer means for extracting a first current signal from a first electrical line that supplies power to a submersible water pump in the one-tenth to three horsepower power range;

a current detector means for processing the first current signal to yield a second current signal having the same phase as the first current signal but having a square wave amplitude;

a switch means for receiving the second current signal;

a synchronous phase detector comprised of an operational amplifier that generates a first output signal by using the second current signal to modify the amplitude of a full cycle of a voltage signal taken from a second electrical line that supplies power to the water pump, the gain of the operational amplifier being varied by the switch means in response to the second current signal;

a filter means for generating a filtered signal derived from the first output signal;

a comparator means for comparing the filtered signal to a reference value and generating a second output signal based on the comparison of the filtered signal to the reference value;

a logic means for processing the second output signal to yield a control signal; and a solid state relay means for turning power to the pump on or off in response to the control signal only at zero crossings of the voltage signal.

21. The water pump control system of claim 18 further comprising:

a water line connection means for connecting the water pump control system to a water line carrying water pumped by the pump;

a transducer means for measuring a water pressure value in the water line connection means; and a display means for displaying the water pressure value.

22. The water pump control system of claim 20 wherein the logic means comprises a programmable array logic device that includes an internal clock for measuring periods of time.

23. A method for detecting mechanical problems in a pump comprising the steps of:

a. using inductive coupling to extract a current signal from a first conductor that supplies electrical current for a pump;

b. using inductive coupling to extract a voltage signal from a second conductor that supplies electrical current for the pump;

c. inputting a full cycle of the voltage signal into a synchronous phase detector, the synchronous phase detector comprising an operational amplifier and a switch means for receiving polarity information about the current signal and for causing a gain adjustment in the operational amplifier in response to the polarity information;

d. generating a first output signal from the operational amplifier comprised of the full cycle of the voltage signal as modified by the gain adjustment caused by the switch means;

e. generating a second output signal derived from the first output signal; and f. interrupting the flow of electrical current to the pump when the second output signal moves outside of a predetermined range.

24. The method of claim 23 further comprising the steps of:

g. starting a timer when the second output signal moves outside of the predetermined range; and h. reestablishing the flow of electrical current to the pump after a predetermined period of time has been established by the timer and a logic circuit.

25. A method for detecting a low liquid condition in a pump comprising the steps of:

a. using inductive coupling to extract a current signal from a source of AC electrical current for a pump that pumps a liquid;

b. using inductive coupling to extract a voltage signal from a source of AC electrical current for the pump;

c. inputting the current signal into a switch means for causing gain adjustments in an operational amplifier in response to polarity information contained in the current signal;

d. generating a first output signal from the operational amplifier comprised of a full cycle of the voltage signal modified by the gain adjustments caused by the switch means;

e. generating a second output signal derived from the first output signal;

f. interrupting the source of AC electrical current to the pump when the second output signal moves outside of a predetermined range, thereby indicating a low volume of the liquid;

g. starting a timer that measures a first interval of time;

h. restoring the source of AC electrical current to the pump after expiration of the first interval of time; and i. repeating steps a–f.

* * * * *